US007525053B2

(12) United States Patent
Babella

(10) Patent No.: US 7,525,053 B2
(45) Date of Patent: Apr. 28, 2009

(54) ENHANCED KEY STRUCTURE WITH COMBINED KEYCAP FOR A MOBILE COMPUTING DEVICE

(75) Inventor: Mark Babella, Salida, CA (US)

(73) Assignee: Palm, Inc., Sunnyvale, CA (US)

( * ) Notice: Subject to any disclaimer, the term of this patent is extended or adjusted under 35 U.S.C. 154(b) by 0 days.

(21) Appl. No.: 11/773,326

(22) Filed: Jul. 3, 2007

(65) Prior Publication Data

US 2008/0060928 A1 Mar. 13, 2008

Related U.S. Application Data

(63) Continuation of application No. 11/530,380, filed on Sep. 8, 2006, now Pat. No. 7,259,339.

(51) Int. Cl.
*H01H 9/00* (2006.01)

(52) U.S. Cl. ..... 200/5 A; 200/520; 200/1 R

(58) Field of Classification Search ..... 200/512–517, 200/520, 265–269, 5 R, 341, 1 R, 5 A
See application file for complete search history.

(56) References Cited

U.S. PATENT DOCUMENTS

| | | | |
|---|---|---|---|
| 3,744,034 | A | 7/1973 | Paul |
| 3,937,952 | A | 2/1976 | Ripley et al. |
| 4,022,993 | A | 5/1977 | Shattuck |
| 4,359,612 | A | 11/1982 | Rooney |
| 4,359,613 | A | 11/1982 | Rooney |

(Continued)

FOREIGN PATENT DOCUMENTS

| | | |
|---|---|---|
| DE | 3235752 | 3/1984 |

(Continued)

OTHER PUBLICATIONS

International Search Report and Written Opinion of the International Searching Authority in International Search Application PCT/US2007/074107, European Patent Office, Dec. 18, 2007, 12 pages.

(Continued)

*Primary Examiner*—Kyung Lee
(74) *Attorney, Agent, or Firm*—Shemwell Mahamedi LLP

(57) ABSTRACT

A key structure assembly is provided for a mobile computing device. The key structure assembly includes a keycap having at least a first segment and a second segment. A first actuation member extends inward into the housing from the first segment of the keycap, and a second actuation member extends inward from the second segment of the key cap. A substrate including a plurality of electrical connects, including a first electrical contact aligned underneath the first actuation member, and a second electrical contact aligned underneath the second actuation member. The keycap is moveable inward to direct either the first actuation member into contact with the first electrical contact, or the second actuation member into contact with the second electrical contact. One or more sections of material are positioned above the first electrical contact and the second electrical contact. The material for the one or more sections is formed from a material that deforms with inward movement of either the first segment or the second segment of the keycap. A layer formed by a thickness of the one or more sections of material extending over the first electrical contact and the second electrical contact is non-uniform in either dimension or amount of material.

22 Claims, 4 Drawing Sheets

U.S. PATENT DOCUMENTS

| | | | | |
|---|---|---|---|---|
| 4,401,864 | A | | 8/1983 | Ichikawa |
| 4,559,705 | A | | 12/1985 | Hodge et al. |
| 4,564,751 | A | | 1/1986 | Alley et al. |
| RE32,419 | E | | 5/1987 | Rooney |
| 4,679,951 | A | | 7/1987 | King et al. |
| 4,762,227 | A | | 8/1988 | Paterson |
| 4,802,210 | A | | 1/1989 | Spencer et al. |
| 4,839,474 | A | * | 6/1989 | Hayes-Pankhurst et al. . 200/5 A |
| 4,847,798 | A | | 7/1989 | Kurashima |
| 4,860,372 | A | | 8/1989 | Kuzunuki et al. |
| 4,916,441 | A | | 4/1990 | Gombrich |
| 4,972,496 | A | | 11/1990 | Sklarew |
| D312,628 | S | | 12/1990 | Yokoi et al. |
| D313,401 | S | | 1/1991 | Tanabe |
| D313,413 | S | | 1/1991 | Langton |
| 5,002,184 | A | | 3/1991 | Lloyd |
| 5,040,296 | A | | 8/1991 | Yerger |
| 5,049,862 | A | | 9/1991 | Dao et al. |
| 5,067,573 | A | | 11/1991 | Uchida |
| 5,128,829 | A | | 7/1992 | Loew |
| 5,165,415 | A | | 11/1992 | Wallace et al. |
| 5,180,891 | A | | 1/1993 | Trumbo |
| 5,181,029 | A | | 1/1993 | Kim |
| 5,205,017 | A | | 4/1993 | Wang |
| 5,231,381 | A | | 7/1993 | Duwaer |
| 5,253,142 | A | | 10/1993 | Weng |
| 5,266,949 | A | | 11/1993 | Rossi |
| 5,274,371 | A | | 12/1993 | Yang et al. |
| 5,280,283 | A | | 1/1994 | Raasch et al. |
| 5,283,862 | A | | 2/1994 | Lund |
| 5,305,394 | A | | 4/1994 | Tanaka |
| D355,165 | S | | 2/1995 | Sakaguchi et al. |
| 5,389,745 | A | | 2/1995 | Sakamoto |
| 5,401,917 | A | | 3/1995 | Yoshida et al. |
| 5,401,927 | A | | 3/1995 | Lundell et al. |
| 5,410,141 | A | | 4/1995 | Koenck et al. |
| 5,426,449 | A | | 6/1995 | Danziger |
| D359,920 | S | | 7/1995 | Sakamoto |
| 5,430,248 | A | | 7/1995 | Levy |
| 5,434,929 | A | | 7/1995 | Beernink et al. |
| D361,562 | S | | 8/1995 | Beltz |
| 5,444,192 | A | | 8/1995 | Shetye et al. |
| 5,448,433 | A | | 9/1995 | Morehouse et al. |
| 5,452,371 | A | | 9/1995 | Bozinovic et al. |
| 5,457,454 | A | | 10/1995 | Sugano |
| D366,463 | S | | 1/1996 | Ive et al. |
| 5,489,924 | A | | 2/1996 | Shima et al. |
| D368,079 | S | | 3/1996 | Ive et al. |
| 5,500,643 | A | | 3/1996 | Grant |
| 5,506,749 | A | | 4/1996 | Matsuda |
| 5,510,584 | A | * | 4/1996 | Norris ..... 200/5 A |
| 5,515,045 | A | | 5/1996 | Tak et al. |
| 5,528,743 | A | | 6/1996 | Tou et al. |
| 5,530,234 | A | | 6/1996 | Loh et al. |
| 5,534,892 | A | | 7/1996 | Tagawa |
| 5,548,477 | A | | 8/1996 | Kumar et al. |
| 5,550,715 | A | | 8/1996 | Hawkins |
| 5,555,157 | A | | 9/1996 | Moller et al. |
| 5,563,631 | A | | 10/1996 | Masunaga |
| 5,564,850 | A | | 10/1996 | Nagaoka |
| 5,576,502 | A | | 11/1996 | Fukushima et al. |
| 5,606,712 | A | | 2/1997 | Hidaka |
| 5,611,031 | A | | 3/1997 | Hertzfeld et al. |
| 5,615,284 | A | | 3/1997 | Rhyne et al. |
| 5,621,817 | A | | 4/1997 | Bozinovic et al. |
| 5,622,789 | A | | 4/1997 | Young |
| 5,630,148 | A | | 5/1997 | Norris |
| 5,635,682 | A | | 6/1997 | Cherdak et al. |
| 5,638,257 | A | | 6/1997 | Kumar et al. |
| 5,642,110 | A | | 6/1997 | Raasch et al. |
| D381,021 | S | | 7/1997 | Williams et al. |
| 5,646,649 | A | | 7/1997 | Iwata et al. |
| 5,657,459 | A | | 8/1997 | Yanagisawa et al. |
| 5,661,641 | A | | 8/1997 | Shinto |
| D383,756 | S | | 9/1997 | Henderson et al. |
| 5,682,182 | A | | 10/1997 | Tsubodaka |
| 5,698,822 | A | | 12/1997 | Haneda et al. |
| D390,509 | S | | 2/1998 | Antzinas et al. |
| 5,717,565 | A | | 2/1998 | Raasch |
| D392,968 | S | | 3/1998 | Johansson |
| 5,737,183 | A | | 4/1998 | Kobayashi et al. |
| D394,449 | S | | 5/1998 | Shimizu |
| 5,757,681 | A | | 5/1998 | Suzuki et al. |
| 5,760,347 | A | | 6/1998 | Notarianni et al. |
| 5,786,061 | A | | 7/1998 | Banfield |
| D398,307 | S | | 9/1998 | Collins |
| 5,810,461 | A | | 9/1998 | Ive et al. |
| 5,818,437 | A | | 10/1998 | Grover et al. |
| 5,821,510 | A | | 10/1998 | Cohen et al. |
| 5,825,353 | A | | 10/1998 | Will |
| 5,831,555 | A | | 11/1998 | Yu et al. |
| 5,831,613 | A | | 11/1998 | Johnson et al. |
| 5,841,901 | A | | 11/1998 | Arai et al. |
| D402,572 | S | | 12/1998 | Han |
| 5,848,298 | A | | 12/1998 | Steere, Jr. et al. |
| 5,889,512 | A | | 3/1999 | Moller et al. |
| D408,021 | S | | 4/1999 | Haitami et al. |
| 5,892,503 | A | | 4/1999 | Kim |
| D411,179 | S | | 6/1999 | Toyosato |
| D411,181 | S | | 6/1999 | Tamaki et al. |
| 5,913,629 | A | | 6/1999 | Hazzard |
| 5,914,708 | A | | 6/1999 | LaGrange et al. |
| 5,915,228 | A | | 6/1999 | Kunihiro et al. |
| 5,941,648 | A | | 8/1999 | Robinson et al. |
| 5,942,177 | A | | 8/1999 | Banfield |
| 5,949,408 | A | | 9/1999 | Kang et al. |
| 5,953,205 | A | | 9/1999 | Kambayashi et al. |
| D416,001 | S | | 11/1999 | Tal et al. |
| D416,256 | S | | 11/1999 | Griffin et al. |
| 5,975,711 | A | | 11/1999 | Parker et al. |
| 5,995,026 | A | | 11/1999 | Sellers |
| D417,657 | S | | 12/1999 | Matsumoto |
| 6,014,009 | A | | 1/2000 | Wierzbicki et al. |
| D420,351 | S | | 2/2000 | Waldner |
| D420,987 | S | | 2/2000 | Miyahara et al. |
| 6,023,779 | A | | 2/2000 | Fullan et al. |
| 6,034,685 | A | | 3/2000 | Kuriyama et al. |
| D422,271 | S | | 4/2000 | Kawashima |
| D423,468 | S | | 4/2000 | Jenkins |
| 6,046,730 | A | | 4/2000 | Bowen et al. |
| 6,049,796 | A | | 4/2000 | Siitonen et al. |
| 6,050,735 | A | | 4/2000 | Hazzard |
| 6,052,070 | A | | 4/2000 | Kivela et al. |
| 6,052,279 | A | | 4/2000 | Friend et al. |
| D424,533 | S | | 5/2000 | Kandalepas |
| D426,236 | S | | 6/2000 | Kim et al. |
| 6,091,956 | A | | 7/2000 | Hollenberg |
| 6,094,197 | A | | 7/2000 | Buxton et al. |
| 6,100,875 | A | | 8/2000 | Goodman et al. |
| 6,102,594 | A | | 8/2000 | Strom |
| 6,102,721 | A | | 8/2000 | Seto et al. |
| 6,103,979 | A | | 8/2000 | Motoyama et al. |
| 6,107,997 | A | | 8/2000 | Ure |
| 6,108,200 | A | | 8/2000 | Fullerton |
| 6,115,248 | A | | 9/2000 | Canova et al. |
| D432,511 | S | | 10/2000 | Eckholm |
| D433,017 | S | | 10/2000 | Martinez |
| 6,129,430 | A | | 10/2000 | Wu |
| 6,148,261 | A | | 11/2000 | Obradovich et al. |
| 6,151,012 | A | | 11/2000 | Bullister |
| 6,151,206 | A | | 11/2000 | Kato et al. |
| 6,157,323 | A | | 12/2000 | Tso et al. |
| D436,591 | S | | 1/2001 | Abston et al. |
| D436,963 | S | | 1/2001 | Kim et al. |

| | | | |
|---|---|---|---|
| 6,170,024 | B1 | 1/2001 | Wakeland et al. |
| 6,178,087 | B1 | 1/2001 | Cho et al. |
| 6,181,284 | B1 | 1/2001 | Madsen et al. |
| 6,195,589 | B1 | 2/2001 | Ketcham |
| D440,542 | S | 4/2001 | Hawkins et al. |
| 6,212,412 | B1 | 4/2001 | Rogers et al. |
| D441,733 | S | 5/2001 | Do et al. |
| 6,239,968 | B1 | 5/2001 | Kim et al. |
| 6,243,789 | B1 | 6/2001 | Hasbun et al. |
| 6,249,276 | B1 | 6/2001 | Ohno |
| 6,266,240 | B1 | 7/2001 | Urban et al. |
| 6,278,442 | B1 | 8/2001 | Griffin et al. |
| 6,283,777 | B1 | 9/2001 | Canova et al. |
| D451,079 | S | 11/2001 | Ali |
| 6,346,973 | B1 | 2/2002 | Shibamoto et al. |
| D454,349 | S | 3/2002 | Makidera et al. |
| D454,849 | S | 3/2002 | Eckholm |
| 6,355,891 | B1 | 3/2002 | Ikunami |
| 6,356,442 | B1 | 3/2002 | Lunsford |
| 6,374,277 | B2 | 4/2002 | Vong et al. |
| D456,794 | S | 5/2002 | Laverick et al. |
| 6,396,482 | B1 | 5/2002 | Griffin et al. |
| D458,239 | S | 6/2002 | Shim et al. |
| D459,327 | S | 6/2002 | Ali |
| D460,068 | S | 7/2002 | Lanaro et al. |
| 6,423,918 | B1 | 7/2002 | King et al. |
| 6,452,588 | B2 | 9/2002 | Griffin et al. |
| 6,459,968 | B1 | 10/2002 | Kochie |
| 6,489,950 | B1 | 12/2002 | Griffin et al. |
| 6,507,336 | B1 | 1/2003 | Lunsford |
| 6,535,199 | B1 | 3/2003 | Canova, Jr. et al. |
| D472,551 | S | 4/2003 | Griffin |
| D473,226 | S | 4/2003 | Griffin |
| D476,985 | S | 7/2003 | Griffin |
| D478,585 | S | 8/2003 | Griffin |
| 6,609,805 | B1 | 8/2003 | Nelson |
| 6,611,254 | B1 | 8/2003 | Griffin et al. |
| 6,611,255 | B2 | 8/2003 | Griffin et al. |
| 6,626,551 | B2 | 9/2003 | Funamoto et al. |
| 6,641,315 | B2 | 11/2003 | King et al. |
| 6,677,931 | B2 | 1/2004 | Chi et al. |
| 6,679,613 | B2 | 1/2004 | Mabuchi |
| 6,717,083 | B2 | 4/2004 | Chen et al. |
| D490,076 | S | 5/2004 | Griffin |
| 6,786,661 | B2 | 9/2004 | King et al. |
| 6,788,285 | B2 | 9/2004 | Paolucci et al. |
| 6,808,325 | B2 | 10/2004 | King et al. |
| D497,907 | S | 11/2004 | Griffin |
| 6,867,763 | B2 | 3/2005 | Griffin et al. |
| 6,873,317 | B1 | 3/2005 | Griffin et al. |
| 6,891,529 | B2 | 5/2005 | Ladouceur et al. |
| 6,918,707 | B2 | 7/2005 | King et al. |
| 6,919,879 | B2 | 7/2005 | Griffin et al. |
| 6,921,221 | B2 | 7/2005 | King et al. |
| 6,923,583 | B2 | 8/2005 | King et al. |
| 6,940,490 | B1 | 9/2005 | Kim et al. |
| 6,981,791 | B2 | 1/2006 | Higashiyama |
| 2002/0021562 | A1 | 2/2002 | Tholin et al. |
| 2002/0196618 | A1 | 12/2002 | Douzono et al. |
| 2003/0112620 | A1 | 6/2003 | Prindle |
| 2004/0165924 | A1 | 8/2004 | Griffin |
| 2005/0248537 | A1 | 11/2005 | Kim et al. |
| 2006/0118400 | A1 | 6/2006 | Chyc et al. |
| 2007/0200828 | A1 | 8/2007 | Skillman |

FOREIGN PATENT DOCUMENTS

| | | |
|---|---|---|
| DE | 10203400 | 6/2003 |
| EP | 0760291 | 3/1997 |
| EP | 1143327 | 10/2001 |
| EP | 1172989 | 1/2002 |
| EP | 1197835 | 1/2002 |
| EP | 1265261 | 12/2002 |
| EP | 1507189 | 2/2005 |
| EP | 1523021 | 4/2005 |
| EP | 1569070 | 8/2005 |
| EP | 1569077 | 8/2005 |
| EP | 1575069 | 9/2005 |
| EP | 1585153 | 10/2005 |
| EP | 1619705 | 1/2006 |
| EP | 1619860 | 1/2006 |
| EP | 1696448 | 8/2006 |
| JP | 2001126588 | 5/2001 |
| WO | WO98/01876 | 1/1998 |
| WO | WO99/37025 | 7/1999 |
| WO | WO00/30381 | 5/2000 |
| WO | WO03/007582 | 1/2003 |
| WO | WO2004/001578 | 12/2003 |
| WO | WO2004/059955 | 7/2004 |

OTHER PUBLICATIONS

"HP iPOQ H4350 Keypad Structure", Mar. 3, 2006, 7 pages.
"Nokia 9500 Up Close", from www.phonescoop.com, Jun. 27, 2006, 2 pages.

* cited by examiner

ENHANCED KEY STRUCTURE WITH COMBINED KEYCAP FOR A MOBILE COMPUTING DEVICE

RELATED APPLICATION INFORMATION

This application is a Continuation of U.S. patent application Ser. No. 11/530,380 filed Sep. 8, 2006, now U.S. Pat. No. 7,259,339 entitled ENHANCED KEY STRUCTURE WITH COMBINED KEYCAP FOR A MOBILE COMPUTING DEVICE, which is hereby incorporated by reference in its entirety.

TECHNICAL FIELD

The disclosed embodiments relate to an enhanced combination key for use on a mobile computing device.

BACKGROUND

Over the last several years, the growth of cell phones and messaging devices has increased the need for keypads and button/key sets that are small and tightly spaced. In particular, small form-factor keyboards, including QWERTY layouts, have become smaller and more tightly spaced. With decreasing overall size, there has been greater focus on efforts to make individual keys more usable to a user. For example, keyboard design considers how readily the user can select or click ("clickability") individual key structures of keyboard. The clickability may be affected by various factors, such as the individual key structure size and shape, as well as the spacing between key structures and the tactile response of individual key structures.

With the growth of small form-factor devices, such as cell phones and wireless messaging devices, design parameters may provide for smaller functional keypads, particularly with respect to keypads that provide character entry. For example, keyboard layouts have been designed using button structures and individual key orientations that reduce the overall surface area of the keypad. Such designs have often focused on QWERTY keyboard layouts, which normally require at least 26-50 individual keys.

In addition to a keyboard, mobile computing devices and other electronic devices typically incorporate numerous buttons to perform specific functions. These buttons may be dedicated to launching applications, short cuts, or special tasks such as answering or dropping phone calls. The configuration, orientation and positioning of such buttons is often a matter of concern, particularly when devices are smaller.

In addition to keypad design, the shape and design of the device housing is also of interest. Along with the display, button sets and/or the keypad are typically one of the limiting factors in the size of a device housing. Consideration is often needed for the geometry and size of the area of the housing that is to accommodate the various button sets (or vice-versa). Various factors and influences may affect the desired housing shape. For example, the shape of the device housing can be made contoured to better fit the user's hand, or to create a distinctive and identifiable shape. Concerns such as the overall thickness or length of the device often play an important role in the overall shape of the housing design.

DETAILED DESCRIPTION

Figure 1A:
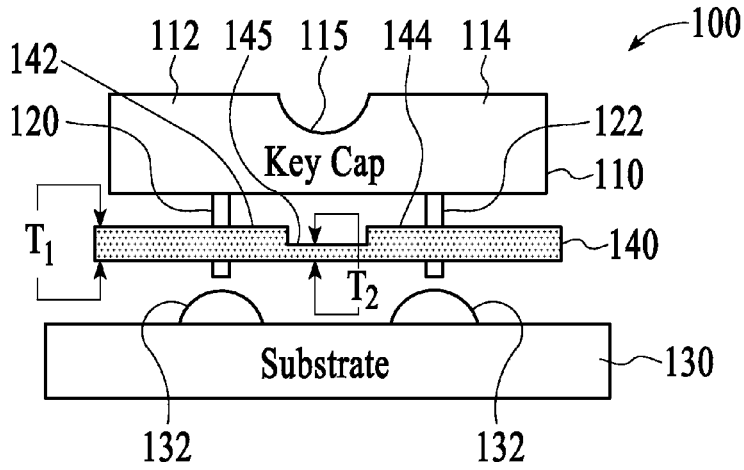
FIG. 1A is a side sectional view of a key structure assembly, according to an embodiment of the invention.

Embodiments described herein include features for enhancing the use and usability of key structures that include combined key caps. Key structures with combined key caps include toggle keys, or other keys that can be moved in more than one direction to have multiple actuated states. According to various embodiments, numerous features are described by which a key structure with a combined key cap is included in one or more locations of the housing of a mobile computing device.

As used herein, a key cap is a portion of a key structure that provides one or more contact surfaces for receiving a finger or object. In a conventional key construction, key caps are formed from a matrix of material such as polycarbonate material (e.g. through injection molding techniques). The key caps may be formed from such material into desired shapes. Multiple key caps may be formed from and reside over a single matrix. In many cases, key caps are separated from one another by a void over the matrix. When key caps are part of an assembled device (e.g. mobile computing device or other small-form factor device), individual key caps are often separated by a thin walls formed from the device housing. A typical key cap may be bulbous in shape, and extend a thickness that extends outward from the surface of a device. While such key cap design may be typical, embodiments described herein may apply to alternative key cap designs, such as flush or sunken key caps.

A key structure refers to vertical and unitarily formed elements that extend inward from the key cap. In one embodiment, the key structure includes a key cap and a plunger or actuation member that extends inward from a bottom surface of the key cap or its matrix.

A key structure assembly corresponds to a stack of elements that support and enable operation of individual key caps.

As used herein, the term "inward", as used in the context of a computing device, means in a direction that is towards an interior of a housing of the device.

As used herein, a combined key cap corresponds to a key structure that has a keycap that can be pushed downward at two or more locations to provide separate inputs for each of the two or more locations. A toggle key is a type of combined key, characterized by the keycap being able to pivot or toggle about a reference. When the keycap of a toggle key is toggled or moved one way, one of the key segments pivots or moves inward to cause one electrical contact element of an underlying substrate to trigger an input. When the keycap is moved another way, another of the key segments pivots or moves inward to cause another electrical contact element of the underlying substrate to trigger another input.

One alternative to a key structure with a combined key cap is the use of multiple key caps (or key structures) that are independent of other key caps or structures. As will be described, in many cases the use of a combined key cap (e.g. toggle key cap) can provide many advantages over such a conventional approach. For example, conventional key caps normally need separation and support from the housing. When space is a consideration, manufacturing considerations can limit the size and shape of a keycap, particularly since housing walls that separate adjacent key caps can be difficult to form past a certain point of minimized thickness. In contrast, a toggle key or other combined key cap structure enables easier construction of housing apertures that provide such key caps, considering that the need for a dividing wall in the housing is eliminated.

However, conventional toggle keys and combined key cap structures are prone to misuse. Because toggle keys pivot, they lack the tactile feel of independent keys, and as such, are more prone to generate mis-hits. Moreover, the design of conventional toggle keys and combined key caps often have to take into account the positioning of the key caps over electrical contacts that are triggered by movement of the key caps into an actuated state. These design considerations have, in the past, limited the ability to vary the dimension or shape of combined key cap structures.

As will be described, one or more embodiments provide features for use in combined key cap structures to enhance use and usability of the corresponding key structure. In one embodiment, a shaped layer of dampening material is provided underneath opposing segments of a combined key cap structure to enhance tactile, independent feel of each segment as a separate key.

According to an embodiment, the key structure that provides a combined key structure includes a separate plunger (alternatively referred as actuation members) for each key structure. Insertion of one segment of the combined key cap directs the plunger of that segment (but not of the other segment) inward into contact with an electrical contact, thus triggering the electrical contact to register an electrical signal. In such an embodiment, silicon rubber or other material that can be characterized as elastic, deformable, or cushion-like (e.g. foam) may be provided underneath the key caps. As well be described, the thickness of the material provided may be varied over a region to enhance tactile feel.

In another embodiment, the segments of the key cap are asymmetrical with respect to one another, so that the centerline of one or more both segments are off center with respect to the position of the actuation member extending inward from that segment. In such a design, it is contemplated that a user who intends to press the one of the two key caps contacts the intended key segment off center, so that the hit is near the smaller segment. If, for example, the intended key is the larger of the two keys, there is the potential that the plunger of the smaller key makes contact with the underlying electrical contact. To avoid falsely recording such mis-hits, one or more embodiments provide that the characteristic actuation force of the electrical contact (i.e. the minimum force necessary to actuate the electrical contact) underlying one key segment is different than the characteristic actuation force of the electrical contact underlying the other key segment. In one embodiment, the characteristic actuation force of the electrical contact underlying the larger of the two key segments is less than the characteristic actuation force of the electrical contact underlying the smaller of the key segments. This makes the larger key segment easier to move into an actuated state, while maintaining the smaller segment in a non-actuated state, even when the user-contact is off-center and near the smaller key segment.

Implementing features for combined key structures in accordance with one or more embodiments described herein further enables more freedom to design key structures with combined key caps. Considerations for sizing, and shaping key segments to align center points with actuation members are minimized, if not eliminated, by altering the characteristic actuation force of the electrical contact. Moreover, combined key caps can be provided to feel and look like separate and independent key caps.

Embodiments described herein may be implemented on any type of small form-factor device that incorporates or uses buttons and/or key. An example of the type of devices that can be used with one or more embodiments include: (i) cellular devices, including telephony and messaging devices, (ii) media players (music and video), (iii) Global Positioning System (GPS) devices, and (iv) digital cameras and video recorders.

Moreover, embodiments described herein may be implemented with various kinds of keys and key structures. For example, navigation buttons (2-way, 4-way and 8-way), application buttons, and key pads may be incorporated with features of one or more embodiments. As an example of an embodiment implemented on a key board, individual keys that comprise the key board may be part of a toggle key pair. As another example, one or more embodiments may be implemented on a key or button set that includes a designated function or application key. Such keys may be actuated to cause an application to execute, or to cause a dedicated function such as a call answer or hang up to be performed. In the case of a combined key cap, one segment of the key cap may be used to perform one designated function (e.g. launch a first application), and another segment of the key cap may be used to perform another function (e.g. launch another application).

According to an embodiment, key structure assembly is provided for a mobile computing device. The key structure assembly includes a keycap having at least a first segment and a second segment. A first actuation member extends inward into the housing from the first segment of the keycap, and a second actuation member extends inward from the second segment of the key cap. A substrate including a plurality of electrical connects, including a first electrical contact aligned underneath the first actuation member, and a second electrical contact aligned underneath the second actuation member. The keycap is moveable inward to direct either the first actuation member into contact with the first electrical contact, or the second actuation member into contact with the second electrical contact. One or more sections of material are positioned above the first electrical contact and the second electrical contact. The one or more sections may be formed from a material that deforms with inward (into the housing) movement of either the first segment or the second segment of the keycap. A layer formed by a thickness of the one or more sections of material extending over the first electrical contact and the second electrical contact is non-uniform in either dimension or amount of material.

Overview

FIG. 1A is a side sectional view of a key structure assembly, according to an embodiment of the invention. A key structure assembly such as shown may be incorporated into any one of many kinds of electronic devices, including mobile computing devices such as cellular devices and audio/video media players.

In an embodiment such as shown by FIG. 1A, a key structure assembly 100 includes a key cap 110, actuation members 120 and 122, and a substrate 130. The plungers 120, 122 are aligned over electrical contacts 132, 132 of the substrate 130, so that inward movement of the key cap 110 causes one of the actuation members to move and make contact with an aligned electrical contact 132. In one implementation, the electrical contacts 132 are metal snap domes, which collapse with application of a force that exceeds a characteristic actuation force. The actuation members 120, 122 may actuate or trigger the corresponding, aligned electrical contacts 132 by inward direction of the key cap 110. Specifically, key cap 110 may include a first segment 112 and a second segment 114. A recess 115 or other delineating formation may separate the first segment 112 from the second segment 114. The recess 115 may be designed to enhance the appearance that the first segment 112 and second segment 114 are separate keys are button. In this way, recess 115 may provide a visual delineation of the individual key segments. In one implementation, the entire key cap 110 is formed from a matrix of material, such as polycarbonate, in a manufacturing process that may result in the formation of other key caps not shown. As such, the key cap 110 may reside on a matrix (not shown) that is shared by one or more other key structures.

The actuation members 120, 122 extend from segments 112, 114 respectively. The key cap 110 may be moved inward by user-contact at one of the segments 112, 114. With such contact, one of the actuation member 120, 122 extending from that segment 112, 114 of the keycap 110 is moved inward into contact with the aligned electrical contact 132, 132. In an implementation shown by FIG. 1, the actuation members 120, 122 are unitarily formed with the key cap, so as to extend inward from an underside of the corresponding segment 112, 114. Manufacturing of such actuation members may be accomplished through use of a molding tool tat can unitarily form the actuation members as extensions from the key caps. However, in another implementation, the actuation members may be provided as a separate and independent layer from the matrix and/or key cap 110.

According to an embodiment, one or more layers of material may be provided to occupy a thickness or dimension between the substrate 130 and the underside of the key caps 110. In one embodiment, one such intermediate layer 140 is formed from polysilicon rubber (or other elastic or deformable material such as foam), or alternatively other material that has a dampening affect on the movement of the actuation members 122, 124 and/or key cap 110. The layer 140 may be provided to enhance a tactile, independent feel of each segment 112, 114 of the key cap 110.

Under one embodiment, the layer 140 is provided as a non-uniform thickness in an area that spans underneath segments 112, 114 of the key cap 110. In one embodiment, the layer 140 is configured to include raised formations 142, 142 underneath each of the first segment 112 and second segment 114 of key cap 110. The raised formations 142, 144 may have a thickness $T_1$. A gap formation 145 is provided between raised formations 142, 144 having a thickness $T_2$, such that $T_1$ is greater than $T_2$. The effect of providing the layer 140 with the nonuniform thickness is that raised portions 142, 144 support respective segments 112, 114 of the key cap 110. Inward direction of the key cap 110 at one of the segments 112, 114 results in the layer biasing towards having the other of the non-contacted segments 112, 114 maintaining its position. In this way, the segment 112, 114 of the key cap 110 receives the contact to move inward, while the other of the raised ends biases and supports the other non-contacted segment in substantially the original position. The gap thickness 145 enables one raised portion 142, 144 to deform, compress and/or move inward more freely of movement/deformation of the other raised portion 142, 144. The effect is to enhance tactile, independent feel of the movement of each segment 112, 114 of the key cap 110 when that segment is contacted by, for example, a user's finger.

As an alternative to having the gap thickness 145 having reduced thickness, one or more embodiments contemplate the gap thickness 145 as having no thickness (e.g. $T_2$=0). Such an implementation would have similar affect of having raised portions 142, 144 of the layer 140 support respective segments 112, 114.

While an embodiment such as shown by FIG. 1A provides for the layer 140 to be formed separately from the key cap and/or key cap matrix, alternative variations are possible. In one embodiment, a separate layer includes the actuation members 122, 124, interconnected by a matrix that is formed from the dampening material. Still further, while an embodiment such as shown by FIG. 1 illustrates actuation members 122, 124 piercing or extending through the layer 140, other embodiments may provide for the layer 140 to physically separate the actuation members from the corresponding electrical contacts 132, 134.

Figure 1B:
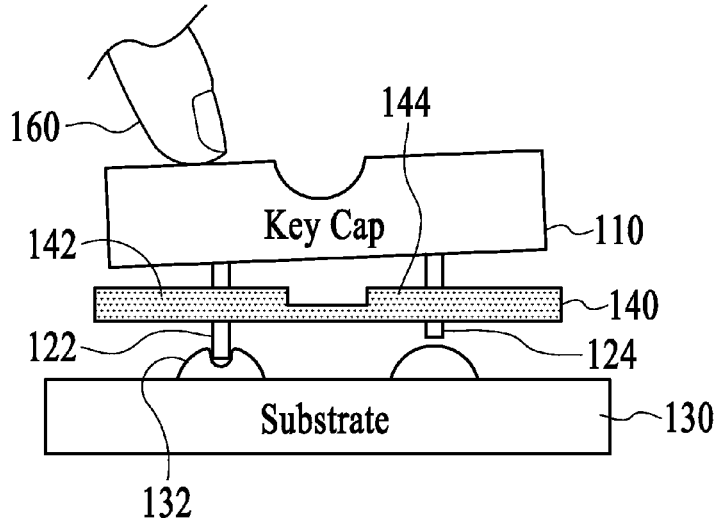
FIG. 1B and FIG. 1C illustrate the key structure assembly of FIG. 1 in each of two possible actuated states.
Figure 1C:
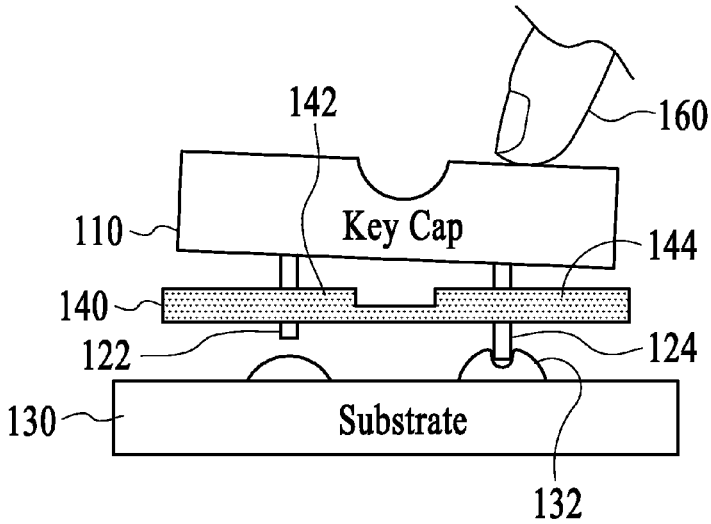

FIG. 1A provides an illustration of a combined key cap, in that key cap 110 of the key structure 100 is moveable in multiple directions (inward about segment 112 or inward about right segment 114) to have multiple actuated states. FIG. 1B and FIG. 1C illustrate the key structure assembly 100 in each of two possible actuated states. In FIG. 1B, a finger 160 presses down on first segment 112 of key cap 110, causing (i) actuation member 122 to move inward and (ii) the raised portion 142 of the layer 140 to deform and move inward underneath the first segment 112. Under an embodiment, while the entire key cap 110 may tilt slightly, the second segment 114 may be substantially unmoved. As mentioned, the raised portion 144 underneath the second segment 114 of the key cap 110 supports the second segment 114 from translating inward or pivoting about an end proximate to the first segment 112.

In FIG. 1C, finger 160 presses down on second segment 114 of key cap 110. This causes the actuation member 124 to move inward. Also, the raised portion 144 of the layer 140 may deform and move inward underneath the first segment 112 of the key cap 110. At the same time, the raised portion 142 underneath the first segment 112 of the key cap 110 supports the first segment 112 from translating inward or pivoting about an end proximate to the second segment 114.

As described below, another feature to distinguish one segment of a combined key cap over another is to provide that each segment has a different characteristic or minimum insertion force necessary to actuate a corresponding underlying electrical contact. The variation in the minimum insertion force needed may be provided through any one of various mechanisms. In one implementation, the actuation member of one segment of a key cap may be less rigid than the actuation member of the other segment of the key cap, so that more force is required to cause the less rigid member to collapse a snap dome contact. Resistance in the form of biasing material may also be provided between the segments of the key cap and the underlying substrate of the electrical contacts. For example, the raised portions 142,144 of the dampening material may be thicker or provide more resistance under one of the segments, meaning that segment would need more force to cause the actuation member to move inward sufficiently to trigger the electrical contact. Still further, as described with an embodiment of FIG. 3B, for example, the characteristic actuation force of the individual electrical contacts may vary from one segment of the key cap to another. For example, the electrical contacts may correspond to snap-dome contacts, and the minimum force needed to cause one dome to collapse may differ from the minimum amount needed to cause the other dome to collapse.

FIG. 2A-FIG. 2D illustrate assembly of a key set comprising a plurality of key caps for use with a mobile computing device, under an embodiment of the invention. A key set 200 such as described with FIG. 2A-FIG. 2D may correspond to a plurality of key structures and/or key caps. In one embodiment, the key set 200 provide application and navigation keys for a mobile computing device, such as described elsewhere in this application.

Figure 2B:
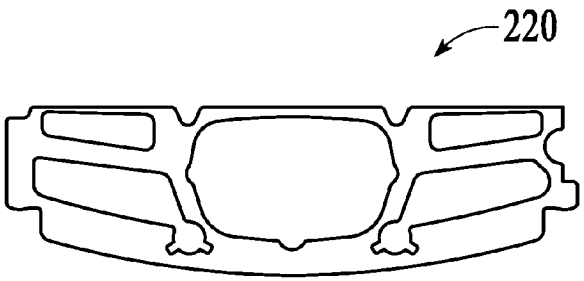
FIG. 2A-FIG. 2D illustrate assembly of a key set comprising a plurality of key caps for use with a mobile computing device, under an embodiment of the invention.
Figure 2C:
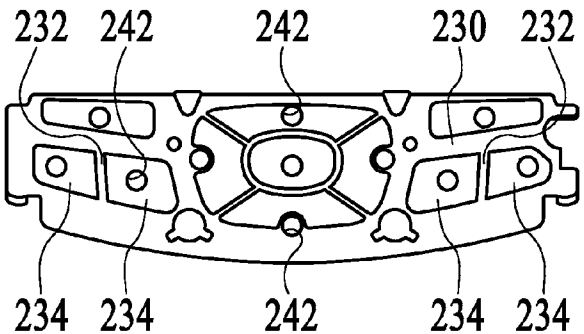
Figure 2D:
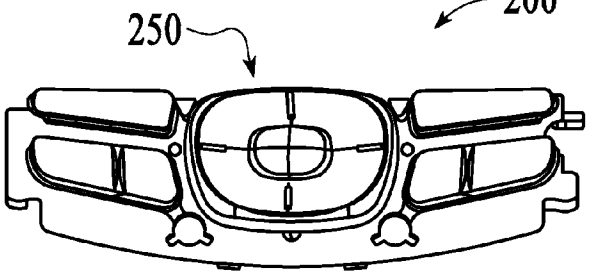
Figure 2A:
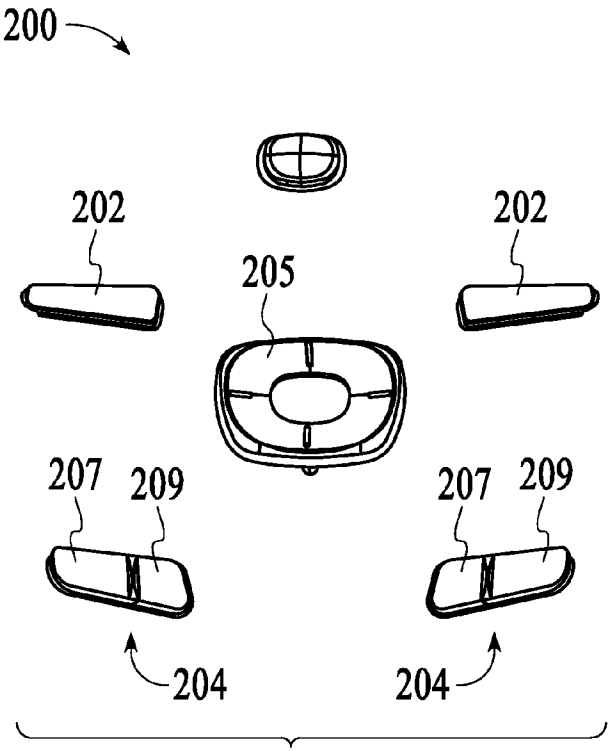

FIG. 2A illustrates a set of key caps for the key set 200. The set of key caps include a plurality of dedicated function key caps 202, 204 and a navigation key cap 205. The dedicated function key caps 202, 204 may correspond to a combined or toggle key cap, having a first segment 207 and second segment 209. The navigation key cap 205 may be multi-directional when implemented (e.g. 4-way or 8-way). In this respect, the navigation key cap 205 provides another form of a combined key cap. In one implementation, dedicated function key caps 202, 204 and the navigation key caps 205 are formed as independent structured. Various surface structures may be integrated to form each the key caps individually. For example, metallic caps may be used to provide one or more of the applications key caps 202, 204 and/or navigation key cap 205.

FIG. 2B illustrates a light-shielding matrix 220 to shield light from reaching or escaping from between the various key structures. The shield may be formed from opaque material, or alternatively light diffusing material to diffuse light from underneath the key caps.

In FIG. 2C, a layer 230 of dampening material is provided to support the key caps over the substrate of electrical contacts (not shown). In one implementation, the material may be formed from silicon rubber. Both the support matrix 220 and the dampening layer 230 are shaped as pieces that conform to the overall shape of the key set. The dampening layer 230 may be provided as a one-piece component, although other embodiments contemplate a multi-piece component. The dampening layer 230 includes gap formations 232, separating raised portions 234. As mentioned with FIG. 1A-FIG. 1C, the raised formations 234 are sized and positioned to support individual key caps 202, 204, 205. The gap formations 232 separate adjacent raised portions 234. The layer 240 may also include apertures 242, for which actuation members (not shown in FIG. 2A-FIG. 2D) may extend through. In one implementation, the actuation members are unitarily formed on undersides of individual key caps 202, 204, and 205. The combined key caps (the designated function key caps 504 and the navigation key cap 205) may include multiple actuation members (i.e. one actuation member for each actuated state).

FIG. 2D shows the key set 250 in assembled form, under an embodiment of the invention. The support structure 220 may provide rigid lateral support to retain the individually formed key caps in position. The dampening layer 240 provides dampening and vertical support, facilitating combined key caps (e.g. dedicated function key caps 504) to feel as independent and separately formed keys.

Asymmetric Combined Key Caps

One or more embodiments described herein contemplate use of combined key caps that have segments that vary in dimension. An example of such an asymmetric key cap is shown by designated function key cap 204 FIG. 2A. One issue that could be presented by asymmetric key caps under a conventional construction is that the larger of the two segments can dominate the other segments. Specifically, the tactile feel of the combined key cap may favor the larger key. In contrast, embodiments such as described with FIG. 1A-FIG. 1C provide dampening materials with non-uniform thickness to enhance independent feel of segments that comprise the combined key cap.

Figure 3A:
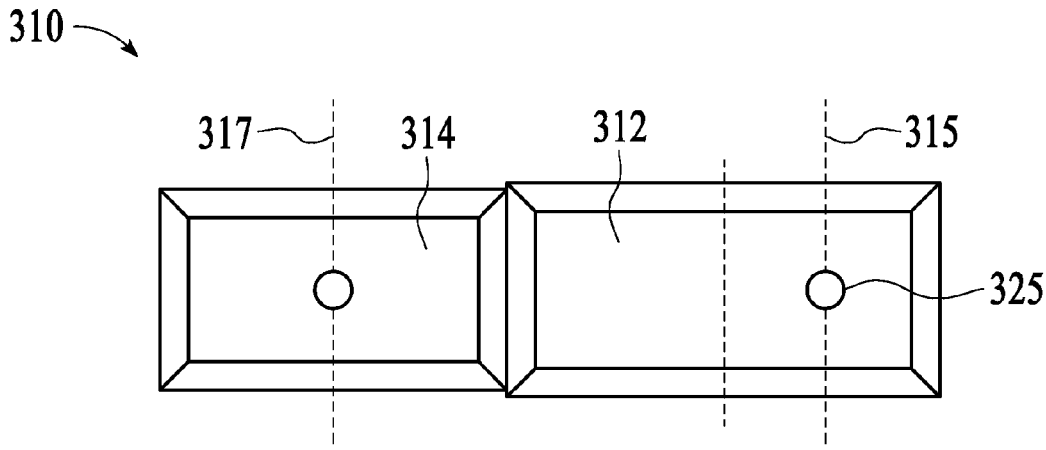
FIG. 3A is a top view of an asymmetric key cap, under an embodiment of the invention.

FIG. 3A is a top view of an asymmetric key cap, under an embodiment of the invention. In FIG. 3A, a key cap 310 includes a large segment 312 and a small segment 314. While the large and small segments 312, 314 are shown to be similar in shape, embodiments described herein contemplate use of non-rectangular or asymmetrical shaped segments. Thus, the particular shape of the segments 312,314 may be one of design choice.

In an embodiment, the positioning of one or both actuation members (not shown in FIG. 3A and FIG. 3B) is offset from corresponding centerlines 315, 317 of each key segment 312, 314. In one embodiment, the centerline 315 of the large segment 312 is offset from the positioning of the actuation member 325 underneath the key cap 312. Such an offset may occur because the actuation members need to be aligned with corresponding electrical contacts on an underlying substrate. However, the key cap 310 may be independently designed, without regard to the positioning of the electrical contacts. Thus, the substrate with the electrical contacts may not be designed to accommodate the particular shape of the key cap 310. Moreover, the shape, size and overall design of the key cap 310 may be made to be independent of the positioning of the electrical contacts of the substrate.

In one embodiment, an underlying key assembly of the key cap 310 is configured to accommodate offset key strikes from falsely registering the wrong segment of the key cap, under an embodiment of the invention. In particular, a finger or other object may strike the large segment 312 of the key cap 310 at or near the centerline 315, as users typically focus on the center of the perceived key (i.e. the center of the key cap). Absent features described herein, if the strike is sufficiently close to the small segment 314, as opposed to the position of the actuation member 325 under the large segment 312, the small segment may insert and actuate its aligned electrical contact. This may occur even if the large segment 314 was struck, because the centerline 315 and actuation member position are offset.

Figure 3B:
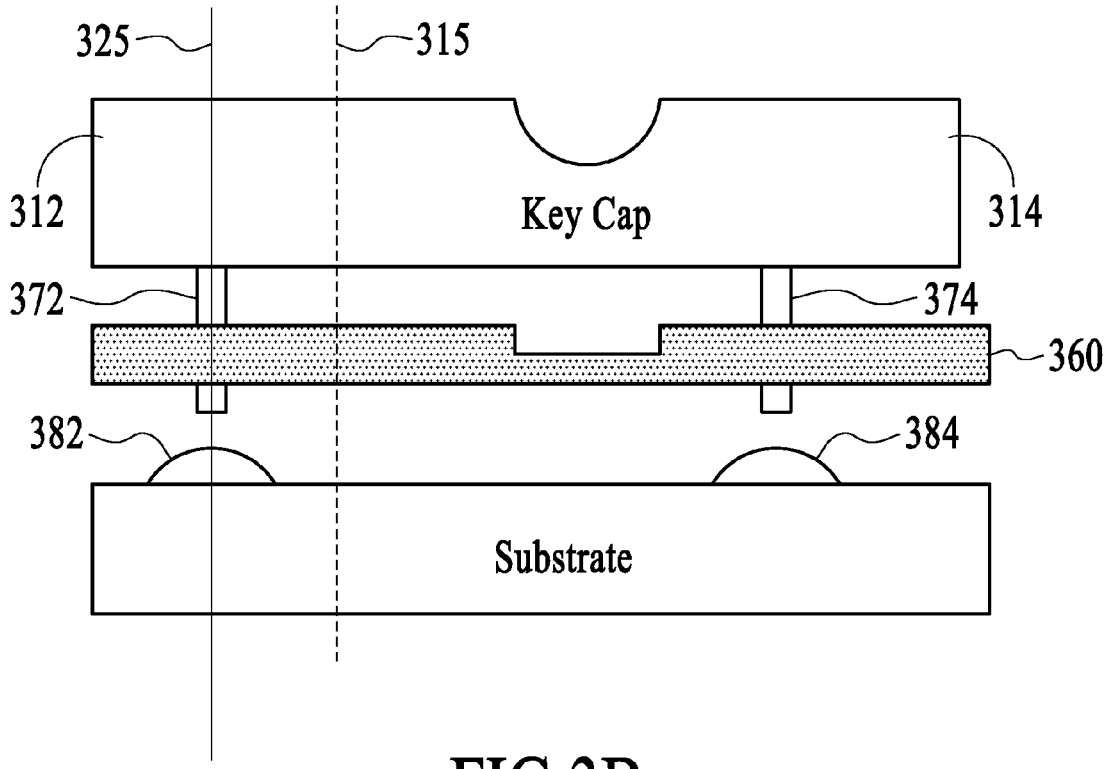
FIG. 3B is a side view of a key structure assembly that provided the combined key cap, under an embodiment of the invention.

FIG. 3B is a side view of a key structure assembly that provided the combined key cap 310, under an embodiment of the invention. In FIG. 3B, a key structure assembly 350 is configured to reduce or eliminate the possibility that an offset key strikes that can falsely registers the wrong segment of the key cap 310. In FIG. 3B, actuation member 372 extends inward from the large segment 312, and actuation member 374 extends inward from the small segment 314. The position of the actuation member 372 under the large segment 312 is shown by reference position 325, which is offset from the centerline 315 of that segment. The position of the actuation member 374 under the small segment 314 may coincide with the centerline 317 of that key cap. As described with one or more other embodiments, the actuation members 372, 374 align to strike corresponding contact elements 382, 384 of an underlying substrate 380. The contact elements 382, 384 may be in the form of snap dome contacts. As described with other embodiments, an optional layer 360 of dampening material may be provided to enhance independent tactile feel of each segment of the key cap 310.

As described with FIG. 3A, users tend to focus on the centerline of each segment 312, 314 of the key cap 310. An accidental key strike that is distal to the actuation member position 325 and offset from the centerline 315 may cause both actuation members 372, 374 to move inward. In order to avoid the wrong actuation member (i.e. actuation member 374 of the small segment) from falsely actuating its aligned electrical element, one or more embodiments provide that the electrical elements 382, 384 have different characteristic actuation forces. In the case of snap dome connectors, this corresponds to the amount of force necessary to cause the snap dome to collapse and trigger. In the situation described by FIG. 3A and FIG. 3B, it is more likely for an intentional strike on large segment 312 to cause inward movement of small segment 314. Accordingly, the minimum or characteristic actuation force of electrical element 382 may be designed to be less than minimum or characteristic actuation force of electrical element. For example, a force of 120-130 grams/force may be needed to actuate the electrical element 382 under the large segment 312, while a more substantial force of 180-190 grams/force is needed to actuate the electrical element 384 under the smaller segment. Such a configuration as shown with FIG. 3B reduces the likelihood that an offset strike of the large segment proximate to the smaller segment 314 would result in the smaller segment being falsely actuated.

As described with other embodiments, variation to the characteristic force of the electrical contacts 382, 384 is just one way for varying the minimum insertion force needed at a given segment of the key pad. As an alternative, other forms of resistance, such as firmer material in the 340 may be used.

Figure 4:
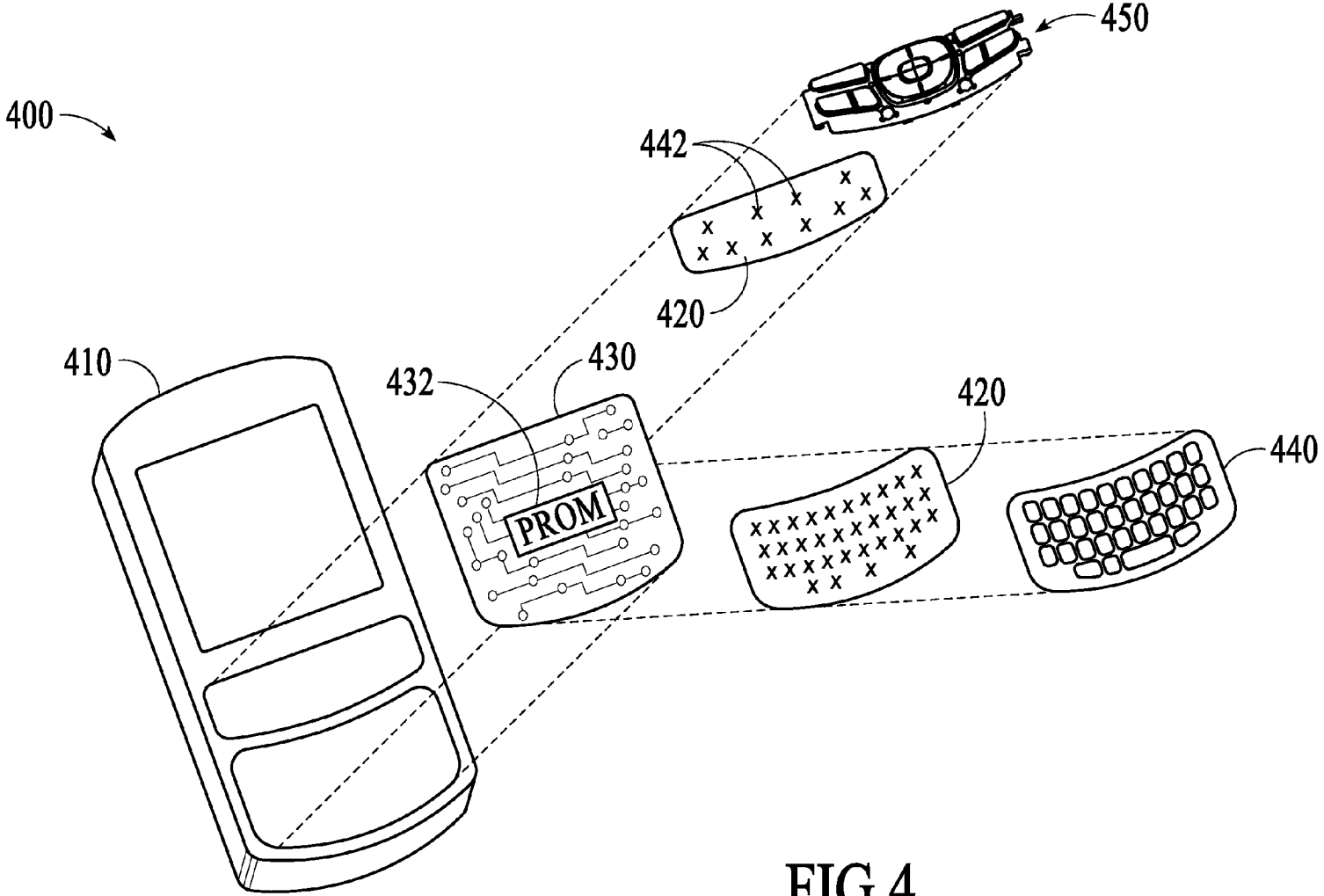
FIG. 4 is an exploded view of a mobile computing device equipped according to one or more embodiments of the invention.

FIG. 4 is an exploded view of a mobile computing device equipped according to one or more embodiments of the invention. In FIG. 4, a mobile computing device 400 includes a housing 410, one or more substrates 420 for supporting key structures, and a printed circuit board 430. The flex printed circuit board 430 and the substrates 420 are contained within the housing 410. The printed circuit board 430 may include components such as processor 432 and memory for the device 400. Other components for forming the computing device that are not shown include, for example, a back face and a display assembly.

Device 400 may include one or more key sets. In an embodiment shown, the key sets of the device 400 include a keyboard 440 and a key set 450 of navigation and dedicated function keys. Either or both the keyboard 440 and/or the key set 450 may incorporate features described with one or more embodiments of the invention. Accordingly, keys in either the keyboard 440 or the key set 450 may include combined key caps (e.g. toggle keys), Furthermore, a layer of dampening material, such as silicon rubber may be provided between the keyboard 440 and the substrate 420, and/or the key set 450 and the substrate 420. As described with FIG. 1A-FIG. 1C, for example, the thickness of such a dampening layer may be non-uniform, with gap recesses formed between keys, and more particularly between segments of structures with combined key caps, such as toggle keys.

In addition, one or more embodiments provide that the characteristic actuation forces of some or all of the electrical contacts 442 on the substrate 420 may vary. For example, similar to an embodiment of FIG. 3A and FIG. 3B, the electrical contacts of one combined key cap may have different characteristic actuation forces to provide tactile and operative distinction between the segments of the combined keys.

The substrate 420 may be equipped with additional features, including lighting design. In one embodiment, the lighting design includes discrete and bright light sources, such as white Light Emitting Diodes. Other implementations may utilize electroluminescent pads on the substrate 420. Other combinations and variations are also contemplated.

In one embodiment, substrate 420 is a stock item, meaning the positioning of the electrical contacts on the substrate 420 are set and not subject to design alterations. In such an environment, embodiments described herein still enable key structure design for combined keys, as issues of asymmetry and offset centerline/actuation member positioning can be accommodated with features described herein.

Although illustrative embodiments of the invention have been described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mention of the particular feature. This, the absence of describing combinations should not preclude the inventor from claiming rights to such combinations.

What is claimed is:

1. A mobile computing device comprising:

a housing containing a plurality of internal components, including one or more processors;

a keyboard including a plurality of keys that are provided on a surface of the housing, wherein at least some of the keys of the keyboard are provided by one or more key structure assemblies that individually include:

a toggle keycap having at least a first segment and a second segment;

a first actuation member extending inward into the housing and aligned under the first segment of the toggle keycap;

a second actuation member extending inward into the housing and aligned under the second segment of the toggle keycap;

a substrate including a plurality of electrical contacts, including a first electrical contact aligned underneath the first actuation member, and a second electrical contact aligned underneath the second actuation member;

wherein the toggle keycap is pivotable inward to direct either the first actuation member into contact with the first electrical contact, or the second actuation member into contact with the second electrical contact; and wherein a minimum force needed to pivot the first actuation member to actuate the first electrical contact is different than a minimum force needed to pivot the second actuation member to actuate the second electrical contact.

2. The mobile computing device of claim 1, wherein a characteristic actuation force of the first electrical contact is different than a characteristic actuation force of the second electrical contact.

3. The mobile computing device of claim 1, wherein a mid-point of the first segment aligns substantially with the first actuation member, and wherein a mid-point of the second segment is offset from the second actuation member.

4. The mobile computing device of claim 3, wherein a distance between the mid-point of the first segment and the mid-point of the second segment is less than a distance between the first actuation member and the second actuation member.

5. The mobile computing device of claim 3, wherein one of the first segment or second segment is larger in size than the other of the first segment or second segment.

6. The mobile computing device of claim 5, wherein the first segment is larger than the second segment, and wherein the minimum force needed to pivot the first actuation member to actuate the first electrical contact is less than the minimum force needed to pivot the second actuation member to actuate the second electrical contact.

7. The mobile computing device of claim 1, further comprising one or more sections of material that are positioned above the first electrical contact and the second electrical contact, wherein the material for the one or more sections is formed from a material that deforms with inward pivoting of either the first segment or the second segment of the keycap.

8. The mobile computing device of claim 7, wherein a firmness of the material positioned above the first electrical contact is different than a firmness of the material positioned above the second electrical contact.

9. The mobile computing device of claim 7, wherein a layer formed by a thickness of the one or more sections of material extending over the first electrical contact and the second electrical contact is non-uniform in dimension or amount of material.

10. The mobile computing device of claim 9, wherein the layer formed by the thickness of the one or more sections includes a gap in the thickness of the material underneath a portion of the keycap between the first segment and the second segment.

11. The mobile computing device of claim 10, wherein the gap in thickness of the material is formed by the thickness of the material being reduced underneath the portion of the keycap between the first segment and the second segment.

12. The mobile computing device of claim 10, wherein the gap in thickness of the material is formed by an absence of the material provided underneath the portion of the keycap between the first segment and the second segment.

13. The mobile computing device of claim 1, wherein at least some of the keys are arranged in a QWERTY type layout.

14. A mobile computing device comprising:

a housing containing a plurality of internal components, including one or more processors;

a keyboard including a plurality of keys that are provided on a surface of the housing, wherein at least some of the keys of the keyboard are provided by one or more key structure assemblies that individually include:

a toggle keycap having at least a first segment and a second segment;

a first actuation member extending inward into the housing and aligned under the first segment of the toggle keycap;

a second actuation member extending inward into the housing and aligned under the second segment of the toggle keycap;

a substrate including a plurality of electrical contacts, including a first electrical contact aligned underneath the first actuation member, and a second electrical contact aligned underneath the second actuation member;

wherein the toggle keycap is pivotable inward, about a reference, to direct either the first actuation member into contact with the first electrical contact, or the second actuation member into contact with the second electrical contact; and wherein a mid-point of the first segment aligns substantially with the first actuation member, and wherein a mid-point of the second segment is offset from the second actuation member.

15. The mobile computing device of claim 14, wherein a distance between the mid-point of the first segment and the mid-point of the second segment is less than a distance between the first actuation member and the second actuation member.

16. The mobile computing device of claim 14, wherein one of the first segment or second segment is larger in size than the other of the first segment or second segment.

17. The mobile computing device of claim 16, wherein the first segment is larger than the second segment, and wherein the minimum force needed to pivot the first actuation member to actuate the first electrical contact is less than the minimum force needed to pivot the second actuation member to actuate the second electrical contact.

18. The mobile computing device of claim 14, wherein a minimum force needed to pivot the first actuation member to actuate the first electrical contact is different than a minimum force needed to pivot the second actuation member to actuate the second electrical contact.

19. The mobile computing device of claim 18, wherein a characteristic actuation force of the first electrical contact is different than a characteristic actuation force of the second electrical contact.

20. The mobile computing device of claim 18, further comprising one or more sections of material that are positioned above the first electrical contact and the second electrical contact, wherein the material for the one or more sections is formed from a material that deforms with inward pivoting of either the first segment or the second segment of the keycap, and wherein a firmness of the material positioned above the first electrical contact is different than a firmness of the material positioned above the second electrical contact.

21. The mobile computing device of claim 14, wherein at least some of the plurality of keys are arranged in a QWERTY type layout.

22. A mobile computing device comprising:

a housing containing a plurality of internal components, including one or more processors;

a keyboard including a plurality of keys that are provided on a surface of the housing, wherein at least some of the keys of the keyboard are provided by one or more key structure assemblies that individually include:

a toggle keycap having at least a first segment and a second segment;

a first actuation member extending inward into the housing and aligned under the first segment of the toggle keycap;

a second actuation member extending inward into the housing and aligned under the second segment of the toggle keycap, the second actuation member having a characteristic actuation force that is different than a characteristic actuation force of the first actuation member;

a substrate including a plurality of electrical contacts, including a first electrical contact aligned underneath the first actuation member, and a second electrical contact aligned underneath the second actuation member;

wherein the toggle keycap is pivotable inward, about a reference, to direct either the first actuation member into contact with the first electrical contact, or the second actuation member into contact with the second electrical contact.

* * * * *